United States Patent [19]

Noé et al.

[11] 4,043,162

[45] Aug. 23, 1977

[54] ROLLER ASSEMBLY FOR SHEET-BENDING HEAD AND METHOD OF MAKING ROLLER BEARINGS THEREFOR

[75] Inventors: Oskar Noé, Mülheim (Ruhr); Wolfgang Skrober, Moers, both of Germany

[73] Assignee: BWG Bergwerk- und Walzwerk-Maschinenbau G.m.b.H., Duisburg, Germany

[21] Appl. No.: 714,277

[22] Filed: Aug. 13, 1976

[30] Foreign Application Priority Data

Aug. 16, 1975 Germany ..... 2536582

[51] Int. Cl.[2] ..... B21D 1/02

[52] U.S. Cl. ..... 72/163

[58] Field of Search ..... 72/165, 164, 163, 160; 308/36

[56] References Cited

U.S. PATENT DOCUMENTS 1,649,706 11/1927 Kelley et al. ..... 72/165 X 3,326,026 6/1967 Guillot ..... 72/163

*Primary Examiner*—Milton S. Mehr

*Attorney, Agent, or Firm*—Karl F. Ross; Herbert Dubno

[57] ABSTRACT

An apparatus for stretching sheet-metal strips includes several bending heads removably mounted between pairs of tension rollers, each bending head comprising a slender deflecting roller journaled in two end bearings and supported by heavier, shorter back-up rollers arrayed in two closely adjoining rows. The back-up rollers of each row have stud shafts cradled in V-shaped notches of a multiplicity of parallel webs transverse to their axis, the webs being integral with a common beam swingably mounted on a supporting frame. Oppositely notched retaining yokes are detachably secured to the webs to hold the roller shafts in place and to complement the notches to diamond-shaped seats for these shafts. The bearing notches of all the webs are simultaneously machined and/or trued by the same tool sweeping thereacross.

10 Claims, 7 Drawing Figures

ROLLER ASSEMBLY FOR SHEET-BENDING HEAD AND METHOD OF MAKING ROLLER BEARINGS THEREFOR

FIELD OF THE INVENTION

Our present invention relates to an apparatus for stretching sheet-metal strips, more particularly to a roller assembly for a bending head forming part thereof, and to a process for making roller bearings for such an assembly.

BACKGROUND OF THE INVENTION

In commonly owned U.S. Pat. No. 3,777,532 there has been disclosed a method of and an apparatus for elongating and simultaneously thinning a sheet-metal band or strip under tension by deflecting that strip, alternately in opposite directions, around rollers of progressively smaller diameters. Such deflecting rollers are generally of slender shape since, on the one hand, they must extend over the full width of the sheet-metal strip and, on the other hand, they are to have a relatively small radius of curvature. It therefore becomes necessary to provide each deflecting roller with rotary supports engaging it over practically its entire length, advantageously in the form of two sets of shorter and heavier coaxially aligned back-up rollers held in closely spaced bearings. The machining and positioning of these bearings requires great precision inasmuch as deviations from exact alignment of adjacent back-up rollers may have a cumulative effect and can result in insufficient contact between the deflecting roller and its back-up rollers whereby, at the high rotary speed customary in such installations, the deflecting roller may break into oscillations leaving objectionable streaks or corrugations on the workpiece.

OBJECTS OF THE INVENTION

An important object of our present invention, accordingly, is to provide an improved system of back-up rollers and bearings therefor which affords proper support for a deflecting roller in a stretching apparatus of the character referred to.

A related object is to provide a method of making such bearings with the requisite precision.

SUMMARY OF THE INVENTION

In accordance with our present invention, a frame forming journals for the extremities of the deflecting roller includes members provided with notches which diverge toward the path of a sheet-metal strip to be stretched, the back-up rollers having stub shafts which are cradled in those notches. The stub shafts may be the projecting ends of a throughgoing shaft or may be separately attached to opposite end faces of the roller body.

Advantageously, pursuant to a more particular feature of our invention, the notched bearing members are webs rising integrally from a common base, namely a beam parallel to the roller axes. Such a rigid relative positioning of the bearing members allows the shaping of the notches or at least the truing of their bearing surfaces by a sweep of one and the same tool — e.g. a miller or a grindstone — in one or more strokes parallel to the base, thereby minimizing the machining tolerances to which the roller bearings are subjected. This technique can also be used for a refinishing of the bearing surfaces after one or more of them have become worn or damaged. For best results, the tool is passed first over all the bearing surfaces on one side of a common plane of symmetry and then over all the bearing surfaces on the other side of that plane, even though in principle the same pass or reciprocation could be used to finish all the bearing surfaces if a suitably shaped tool is available.

Brief Description of the Drawing

The above and other features of our invention will now be described in detail with reference to the accompanying drawing in which.

SPECIFIC DESCRIPTION

Figure 1:
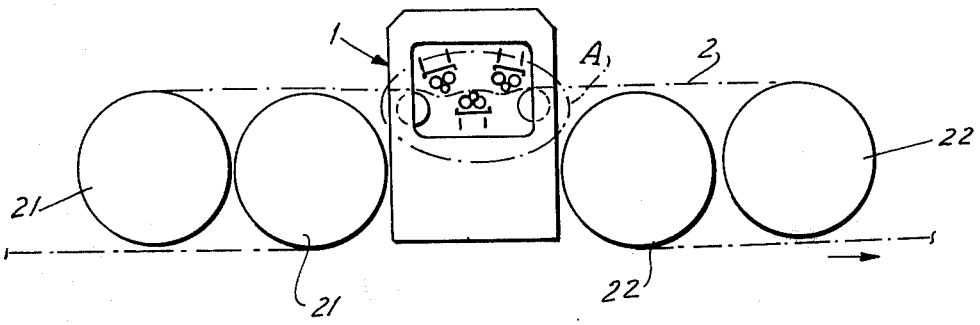
FIG. 1 is a schematic elevational view of a stretching apparatus including several bending heads according to our invention.
Figure 1A:
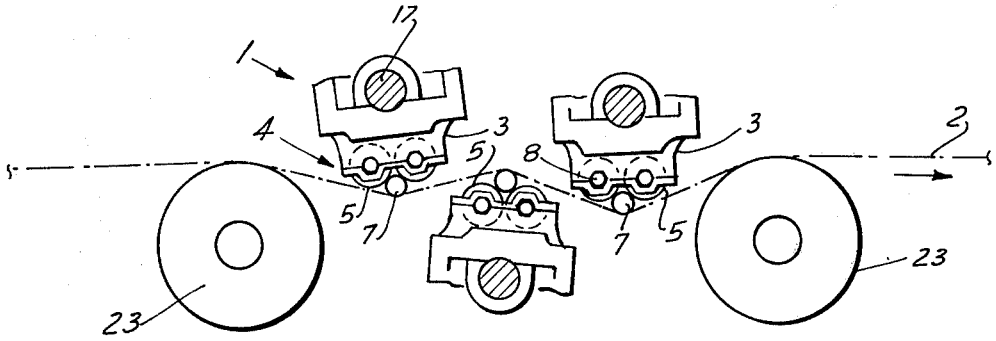
FIG. 1*a* is an enlarged detail view of part of the apparatus encompassed by an area marked A in FIG. 1, including the bending heads.
Figure 2:
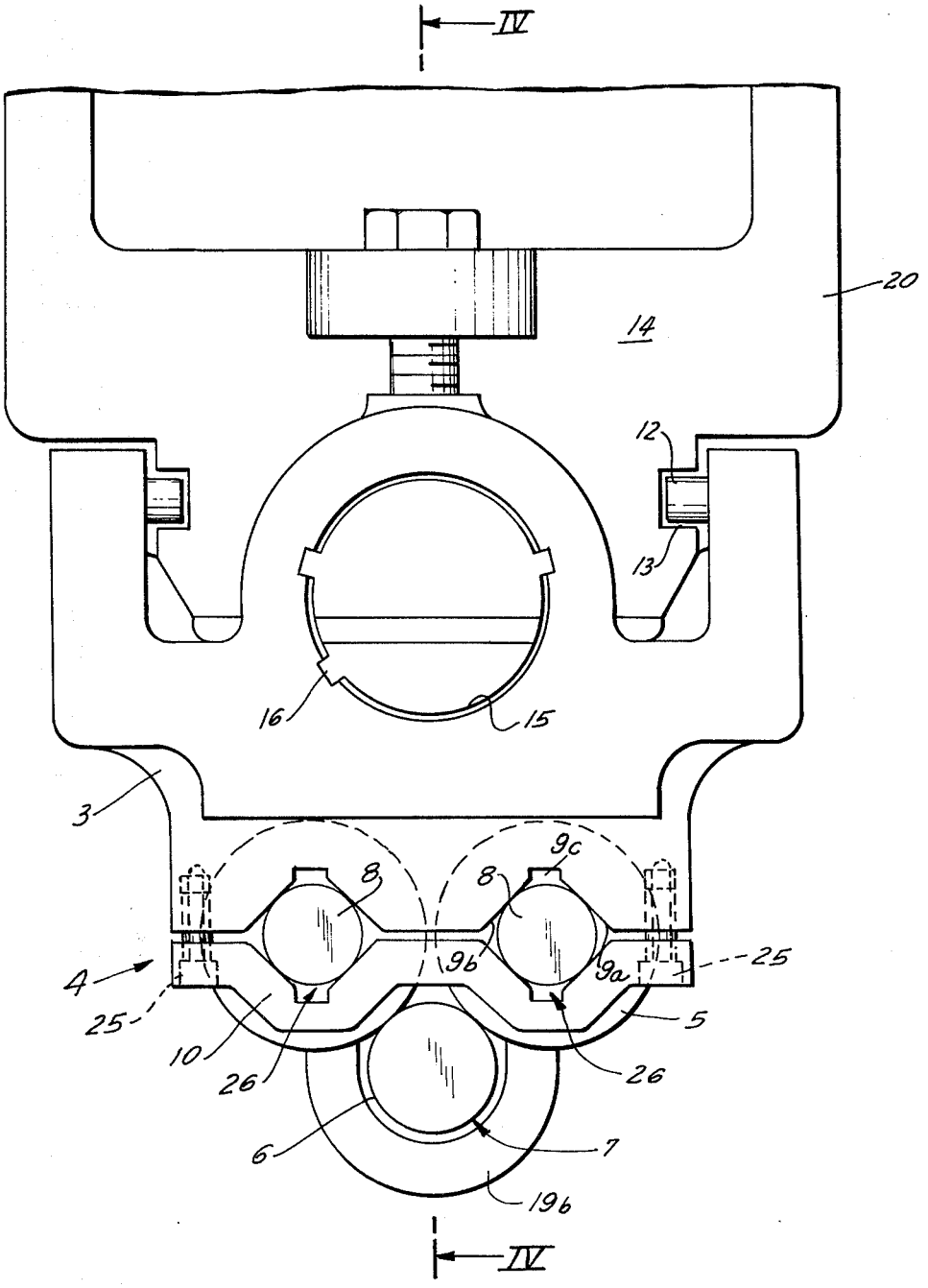
FIG. 2 is an end view of one of the bending heads shown in FIGS. 1 and 1*a*, drawn to a still larger scale.
Figure 3:
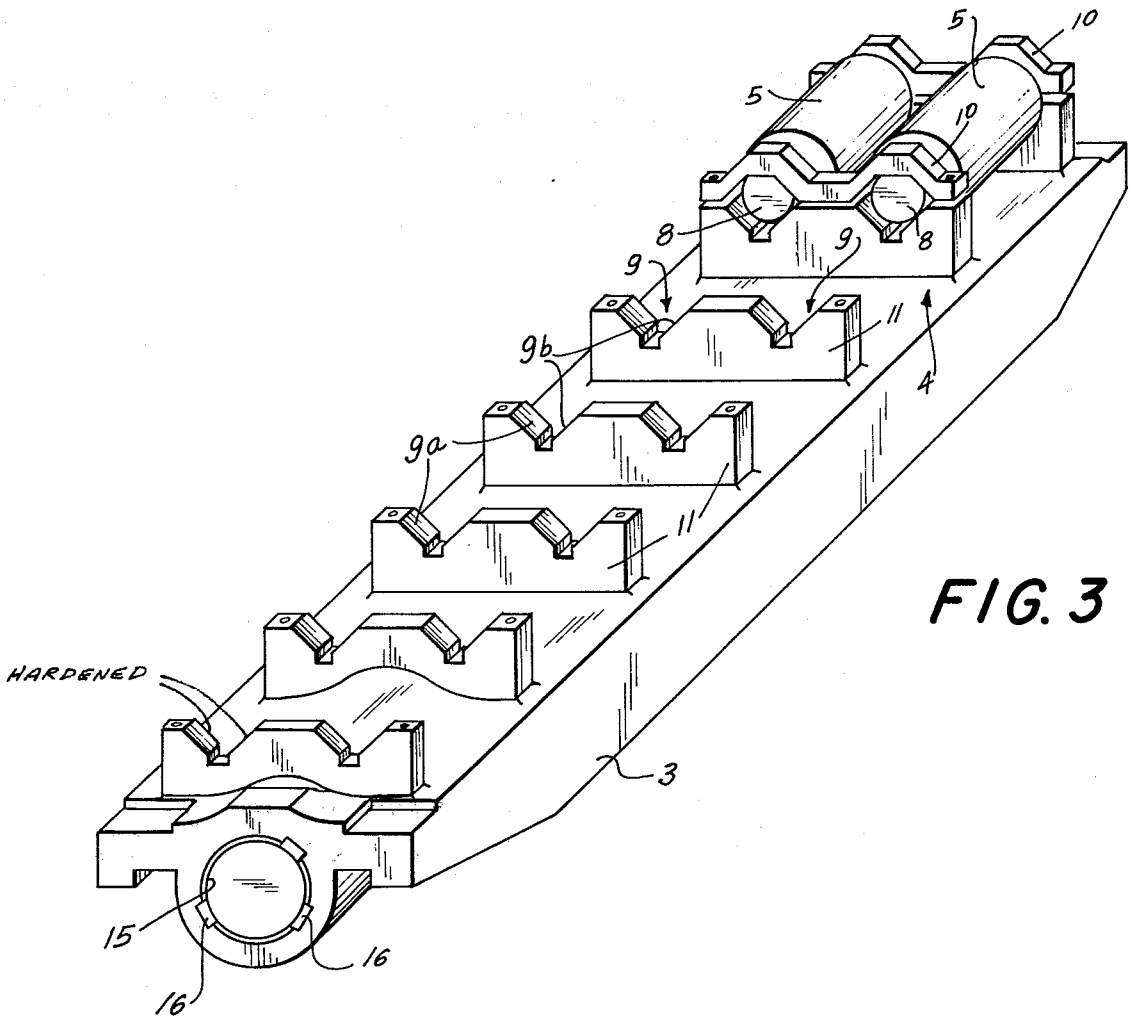
FIG. 3 is an isometric view of a supporting beam for an array of back-up rollers included in the bending head of FIG. 2.
Figure 5:
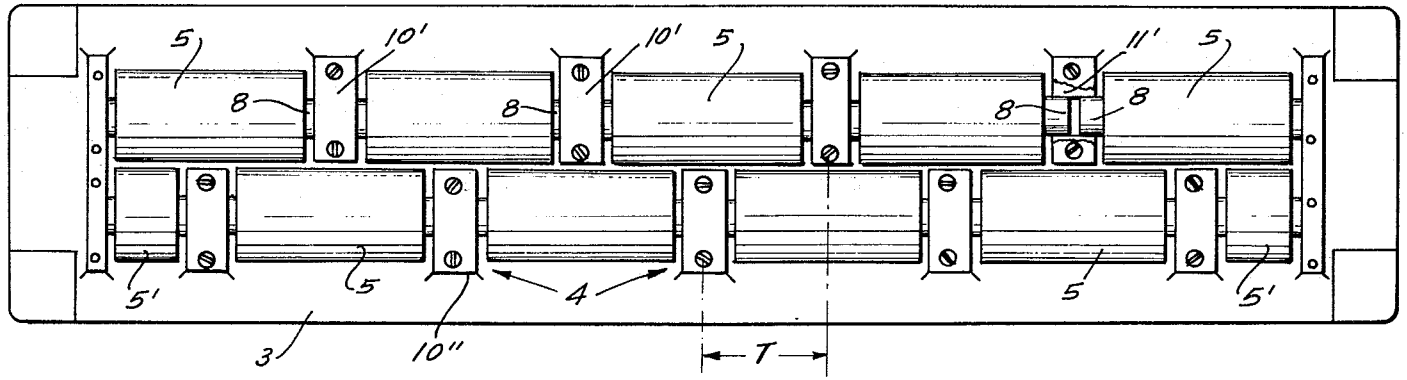
FIG. 5 is a plan view of a modified array of back-up rollers together with the associated supporting beam.
Figure 4:
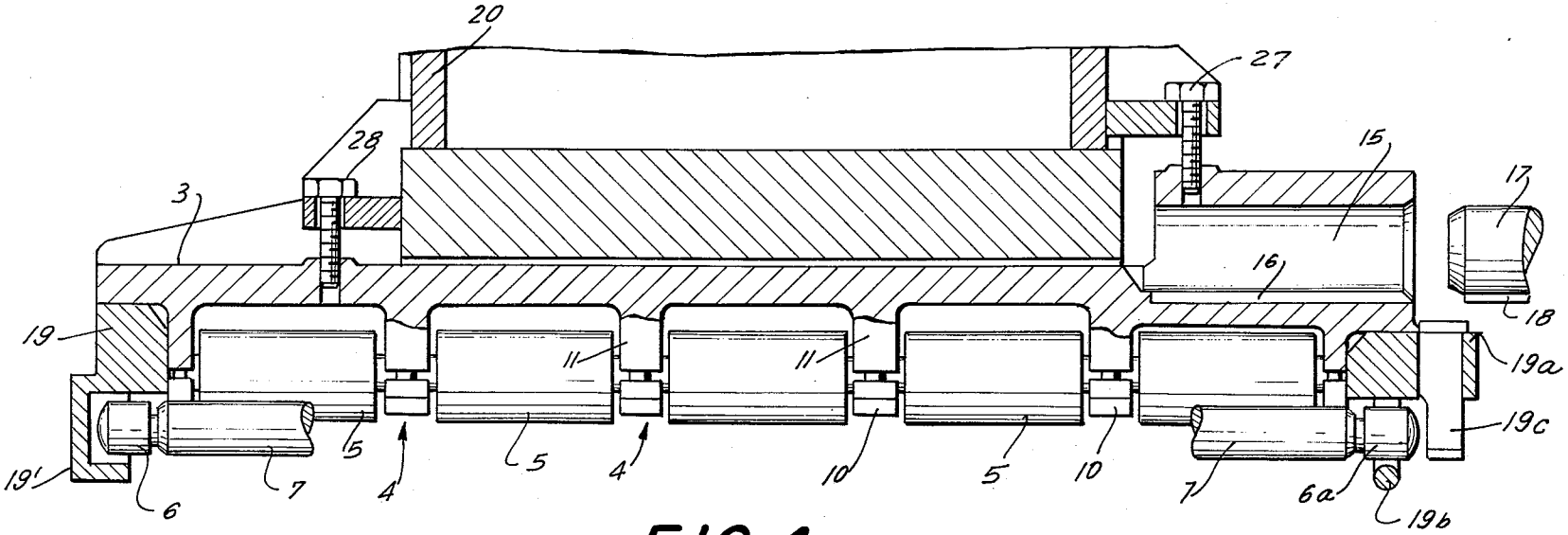
FIG. 4 is an axial sectional view of the bending head taken on the line IV — IV of FIG. 2.

In FIG. 1 we have illustrated a stretching apparatus comprising several bending heads 1 for alternately flexing a sheet-metal strip 2 in opposite directions, the strip being held under tension by roller pairs 21, 22 flanking the heads 1. As more clearly seen in FIG. 1*a*, the apparatus includes two supporting rollers 23, 24 upstream and downstream, respectively, of the several bending heads 1, each bending head comprising a roller assembly 4 which includes an elongate deflecting roller 7 and two coaxial sets of back-up rollers 5 contacting the deflecting roller at locations remote from the path of the strip 2. The back-up rollers 5 have stub shafts 8 which, as best seen in FIGS. 2 and 3, are cradled in generally V-shaped notches 9 of webs 11 rising integrally from a beam 3 which spans the sheet-metal strip 2 and is provided at one end with a mounting hole 15 parallel to the roller axes. The notches 9 have flat, mutually perpendicular lands 9*a*, 9*b* defining the arms of the V, these lands lying on opposite sides of a plane of symmetry bisecting the notch and being separated from each other by an indentation 9*c* for easier machining. The bearing surfaces formed by lands 9*a*, 9*b* are preferably hardened, either directly on the webs 11 or by being clad with refractory coatings. As will be apparent from FIGS. 3 and 5, each stub shaft 8 extends slightly less than half-way into the corresponding notch 9 except at the ends of the array. In the arrangement of FIGS. 3 and 4 the rollers 5 of the two coaxial sets are axially coextensive and supported by common bearing webs 11 which are therefore provided with two notches each. In FIG. 5 we have illustrated a modified arrangement in which these rollers are relatively staggered by a distance T corresponding to half the center spacing of adjacent webs; this modification requires the use of foreshortened end rollers 5' in one of the sets and individual webs 11' with only one bearing notch per web.

In order to hold the stub shafts 8 of the back-up rollers in position, especially in the absence of a workpiece 2, we provide each web 11 or 11' with an individual retainer 10 or 10' secured thereto by countersunk screws 25. The retainers are straps with recesses 26 which confront the notches 9 of the webs to form seats occupied by the stub shafts 8. In FIG. 2 the recesses 26 are shown to have the same V-shape as the notches 9; in FIG. 3 they have a simpler trapezoidal configuration.

Beam 3 forms part of a frame also including a housing 20 secured to the beam by pins 13 sliding in horizontal grooves 13 (FIG. 2) and by fastening screws 27, 28 (FIG. 4). The housing, illustrated only in part, may contain a drive mechanism for imparting positive rotation to the deflecting roller 7, possibly via some of its back-up rollers 5. Roller 7 is loosely journaled on beam 3 by means of blocks **19, 19*a* secured to the beam (block 19*a* being omitted in FIG. 2) to engage respective extremities 6, 6*a* of roller 7. Extremity 6 is received in a recess of an extension 19' of block 19 whereas extremity 6*a* is embraced by an eye 19*b* carried on block 19*a*; this block also has a bore receiving a latch pin 19*c* which must be removed if it is desired to extract the roller 7** from its journals.

The axially extending mounting hole 15 of beam 3 allows for the insertion of a stud 17 on which the head 1 can thus be cantilevered in one of several angular positions as determined by several keyways 16 accommodating a key 18 on stud 17. This stud is carried on a nonillustrated holder which can be raised or lowered to vary the depth of penetration of roller 7 into the path of strip 2 or to retract the roller completely from that path. Upon such retraction the carriage may be displaced transversely to move the roller array out of alignment with the strip. Beam 3 may be fastened to stud 18 by one or more nonillustrated setscrews.

Each bending head 1 can therefore be easily removed and replaced, in the same or in a different angular position, by unskilled personnel. The removal and replacement of the deflecting roller 7 or any of its back-up rollers 5 is equally simple.

Figure 6:
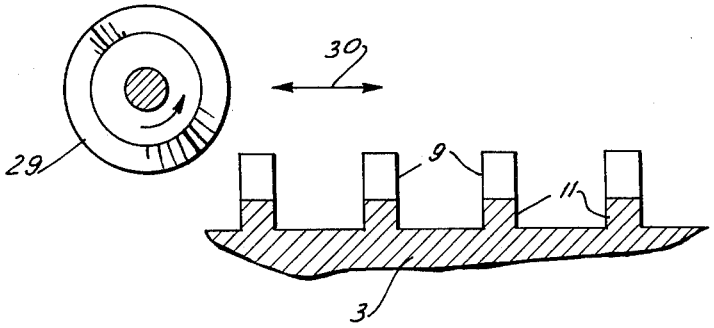
FIG. 6 diagrammatically depicts the machining of bearing surfaces on a set of webs integral with the beam of FIG. 3.

In FIG. 6 we have schematically indicated a rotary tool 29 reciprocable (arrow 30) across a row of webs 11, parallel to the surface of beam 3, in order to shape or at least to finish the notches 9 as described above.

A set of bending heads as herein disclosed may also be used with hot-rolled strips as described and claimed in commonly owned application Ser. No. 714,279 filed by one of us, Oskar Noé, on even date with the present application.

We claim:

1. A bending head for stretching a tensioned sheet-metal strip, comprising:

an elongate deflecting roller extending across a path of a strip to be stretched;

two sets of back-up rollers, shorter and heavier than said deflecting roller, contacting said deflecting roller at locations remote from said path, the back-up rollers of each set being aligned along a common axis parallel to the deflecting-roller axis and being each provided with a pair of stub shafts on opposite ends; and a frame forming journals for the extremities of said deflecting roller and bearings for said back-up rollers, said bearings including members provided with notches diverging toward said path, said stub shafts being cradled in said notches.

2. A bending head as defined in claim 1 wherein said frame comprises a beam parallel to the axes of said deflecting and back-up rollers, said members being webs transverse to said axes and integral with said beams.

3. A bending head as defined in claim 2 wherein the back-up rollers of said sets are axially coextensive, each of said webs having two notches receiving the stub shafts of back-up rollers from respective sets.

4. A bending head as defined in claim 2 wherein the back-up rollers and webs of one set are staggered with reference to the back-up rollers and webs of the other set.

5. A bending head as defined in claim 2 wherein the stub shafts of axially adjoining back-up rollers are supported by a common web and extend from opposite sides into a notch thereof.

6. A bending head as defined in claim 2 wherein said beam is provided at one end with a mounting hole parallel to said axes.

7. A bending head as defined in claim 2, further comprising retainers removably secured to said webs and overlying said notches for holding said stub shafts in position.

8. A bending head as defined in claim 7 wherein said retainers have recesses confronting said notches, said stub shafts being received partly in said notches and partly in said recesses.

9. A bending head as defined in claim 1 wherein said notches have hardened seating surfaces for said stub shafts.

10. A bending head as defined in claim 9 wherein said seating surfaces are flat lands perpendicular to each other.

* * * * *